US006336507B1

(12) United States Patent
Collins

(10) Patent No.: US 6,336,507 B1
(45) Date of Patent: Jan. 8, 2002

(54) DEFORMED MULTIPLE WELL TEMPLATE AND PROCESS OF USE

(75) Inventor: Gary J. Collins, Richmond, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 08/892,709

(22) Filed: Jul. 15, 1997

Related U.S. Application Data

(63) Continuation-in-part of application No. 08/508,635, filed on Jul. 26, 1995, now Pat. No. 5,655,602, and a continuation-in-part of application No. 08/548,565, filed on Oct. 26, 1995, now Pat. No. 5,685,373.

(51) Int. Cl.[7] ..... E21B 7/06; E21B 23/12
(52) U.S. Cl. ..... 166/313; 166/117.5; 166/387
(58) Field of Search ..... 166/313, 117.6, 166/117.5, 50, 52, 387

(56) References Cited

U.S. PATENT DOCUMENTS

| | | | | |
|---|---|---|---|---|
| 1,900,163 A | | 3/1933 | Dana et al. | |
| 1,900,164 A | | 3/1933 | Dana et al. | |
| 2,492,079 A | | 12/1949 | Wiley | 166/117.5 |
| 2,699,920 A | * | 1/1955 | Zublin | 166/117.6 X |
| 3,100,529 A | | 8/1963 | McStravick et al. | 166/52 |
| 3,330,349 A | | 7/1967 | Owsley et al. | |
| 3,357,489 A | * | 12/1967 | Brown | 166/313 |
| 3,653,435 A | | 4/1972 | Reistle, III et al. | |
| 4,068,729 A | | 1/1978 | Peevey | 175/8 |
| 4,396,075 A | | 8/1983 | Wood et al. | 175/79 |
| 4,415,205 A | | 11/1983 | Rehm et al. | 299/5 |
| 4,444,276 A | | 4/1984 | Peterson, Jr. | 175/61 |
| 4,573,541 A | | 3/1986 | Josse et al. | 175/78 |
| 4,606,410 A | * | 8/1986 | Becker et al. | 166/313 |
| 5,318,121 A | | 6/1994 | Brockman et al. | 166/313 |
| 5,318,122 A | | 6/1994 | Murray et al. | 166/313 |
| 5,322,127 A | | 6/1994 | McNair et al. | 166/313 |
| 5,325,924 A | | 7/1994 | Bangert et al. | 166/313 |
| 5,330,007 A | | 7/1994 | Collins et al. | 166/313 |
| 5,353,876 A | | 10/1994 | Curington et al. | 166/313 |
| 5,388,648 A | | 2/1995 | Jordan, Jr. | 166/380 |
| 5,454,430 A | | 10/1995 | Kennedy et al. | 166/50 |
| 5,472,048 A | | 12/1995 | Kennedy et al. | 166/50 |
| 5,474,131 A | | 12/1995 | Jordan, Jr. et al. | 166/313 |
| 5,494,106 A | * | 2/1996 | Gueguen et al. | 166/277 |
| 5,520,252 A | | 5/1996 | McNair | 166/313 |
| 5,533,573 A | | 7/1996 | Jorden, Jr. et al. | 166/313 |
| 5,560,435 A | | 10/1996 | Sharp | 175/5 |
| 5,564,503 A | | 10/1996 | Longbottom et al. | 166/313 |
| 5,806,614 A | * | 9/1998 | Nelson | 166/313 X |
| 5,944,107 A | * | 8/1999 | Ohmer | 166/313 |
| 6,056,059 A | * | 5/2000 | Ohmer | 166/313 |

FOREIGN PATENT DOCUMENTS

| | | |
|---|---|---|
| DE | 2 229 117 | 6/1972 |
| EP | 0 136 935 A1 | 8/1984 |
| EP | 0 795 679 A2 | 2/1997 |
| FR | 1 254 866 | 1/1961 |
| GB | 2 220 015 A | 12/1989 |

OTHER PUBLICATIONS

"Down Hole Splitter," (Brochure), Baker Oil Tools, a Baker Hughes Company, (1994).

Teel, Mark E., "What's Happening in Drilling," *World Oil*, (Nov. 1993), pp. 25 and 36.

"Multilateral Technology: Taking Horizontal Wells to the Next Level," *Hart's Petroleum Engineer International*, Hart Publications, Inc., Sponsored by Sperry Sun Drilling Services, Inc., (1997), pp. 1–16.

* cited by examiner

*Primary Examiner*—David Bagnell
*Assistant Examiner*—Jong-Suk Lee
(74) *Attorney, Agent, or Firm*—Jack E. Ebel

(57) ABSTRACT

A deformed multiple well template and a process for positioning the deformed template downhole, expanding the template and drilling at least one subterranean well bore via said template. The template has at least a portion thereof deformed and may be symmetrical or asymmetrical as deformed and/or expanded.

27 Claims, 13 Drawing Sheets

Fig. 10a
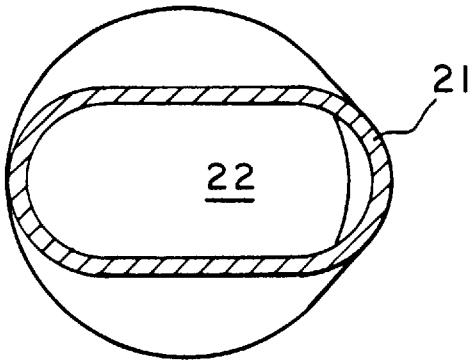
Fig. 10b
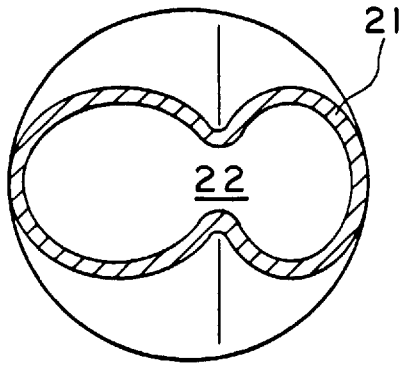
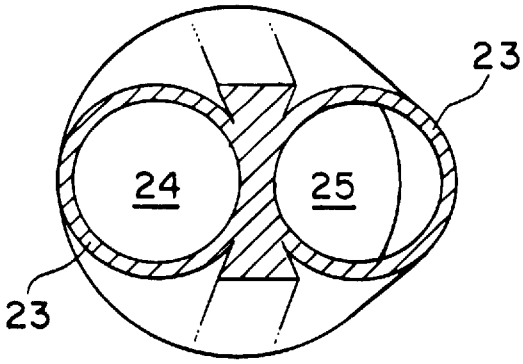
Fig. 11a
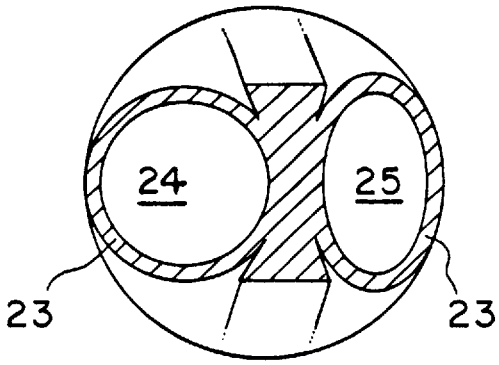
Fig. 11b

DEFORMED MULTIPLE WELL TEMPLATE AND PROCESS OF USE

CROSS-REFERENCE TO RELATED APPLICATIONS

This application is a continuation-in-part of U.S. patent application, Ser. No. 08/508,635, filed on Jul. 26, 1995, now U.S. Pat. No. 5,655,602, and U.S. patent application, Ser. No. 08/548,565, filed on Oct. 26, 1995, now U.S. Pat. Ser. No. 5,685,373.

BACKGROUND OF THE INVENTION

1. Field of the Invention

The present invention relates to a multiple well template and process of drilling multiple subterranean wells utilizing the template, and more particularly, to such a template and process wherein the template is deformed, positioned within a subterranean well bore and expanded for use in drilling multiple wells.

2. Description of Related Art

Increasingly, well bores are being drilled into subterranean formations at an orientation which is purposely deviated from true vertical by means of conventional whipstock technology or a mud motor secured in the drill string adjacent the drill bit. In fractured subterranean formations, deviated wells are utilized to increase the area of drainage defined by the well within the subterranean formation, and thus, increase production of hydrocarbons from the subterranean formation. An inherent problem in utilizing a conventional whipstock to drill a deviated well is that both the depth and radial orientation of the whipstock is set when the whipstock is positioned in the well bore and cannot be changed without retrieving the whipstock from the well bore and changing the depth and/or radial orientation thereof.

In addition, wells drilled from offshore drilling platforms are usually deviated to increase the number of wells which can be drilled and completed from a single platform. Offshore drilling platforms which are utilized in deep water to drill and complete wells in a subterranean formation vary in size, structure, and cost depending upon the water depth and the loads in which the platform will be set. For example, a platform may be constructed to be supported in part by one leg or caisson which extends to the ocean floor or by as many as eight such legs or caissons. Costs of such offshore drilling platforms vary from approximately $5,000,000 to $500,000,000. Each offshore drilling platform is equipped with a set number of slots via which deviated wells can be drilled and completed through surface casing which is secured at the mudline by conventional techniques.

Due to the significant capital expenditure required for these offshore platforms, templates and processes for drilling and completing multiple wells via a single conductor, surface or intermediate casing have been developed. Although the templates which have been developed can be utilized to drill and complete wells into subterranean formations or zones of the same or varying depths, these templates are not designed to drill and complete conventional sized bores, e.g. 7 inches, from a well bore of a similar conventional size so as to maximize the production rate of fluid from the subterranean formation(s) and/or zone(s) and provide mechanical integrity and a hydraulic seal at the template. Thus, a need exists for apparatus and processes to drill and complete multiple subterranean wells of a conventional size from a well bore of a similar conventional size into a plurality of subterranean formations or zones. A further need exists for an apparatus and process to drill and complete multiple subterranean well bores at greater degrees of separation from each other thereby significantly increasing the area of drainage and thus enhancing hydrocarbon recovery from the well.

Accordingly, it is an object of the present invention to provide a deformed template and process for drilling and completing multiple subterranean wells having bore sizes which substantially correspond to the size of the bore from which the multiple wells are being drilled utilizing such template.

It is another object of the present invention to provide a process for expanding a multi well deformed template in situ.

It is a further object of the present invention to provide a deformed template and process for drilling and completing multiple wells from an already existing well bore once such template is expanded which is cost effective.

It is still another object of the present invention to provide a deformed template and process for drilling and completing multiple subterranean wells using such template wherein mechanical integrity and a hydraulic seal at the template are provided.

SUMMARY OF THE INVENTION

To achieve the foregoing and other objects, and in accordance with the purposes of the present invention, as embodied and broadly described herein, one characterization of the present invention may comprise a deformed template for drilling and completing multiple subterranean wells from a first casing which is positioned in a subterranean well bore. The template comprises a body having at least two tubulars, each of which are deformed to permit passage within the subterranean well bore but capable of being expanded upon application of suitable force, and means for securing the body to the first casing.

In another characterization of the present invention, a template is provided for drilling and completing multiple subterranean wells from a first casing which is positioned within a subterranean well bore. The template comprises a body and means for securing the body to the first casing. The body has a first end face and a plurality of axially extending bores therethrough which intersect the first end face. At least one of the axially extending bores being deformed for positioning within the subterranean well bore and capable of being expanded.

In yet another characterization of the present invention, a process is provided for drilling wells via a first casing which extends from the surface of the earth into a first subterranean well bore. The process comprises securing a deformed template having at least two tubulars which are deformed to the first casing, expanding each of the at least two tubulars, and drilling a second subterranean well bore through one of the at least two tubulars into a first subterranean formation.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings:

FIG. 10*a* a is a sectional view of another embodiment of the template of the present invention taken along the line 10*a*—10*a* of FIG. 8;

FIG. 10*b* is a sectional view of another embodiment of the template of the present invention taken along the line 10*b*—10*b* of FIG. 9;

FIG. 11*a* is a sectional view of another embodiment of the template of the present invention taken along the line 11*a*—11*a* of FIG. 8;

FIG. 11*b* is a sectional view of another embodiment of the template of the present invention taken along the line 11*b*—11*b* of FIG. 9;

DETAILED DESCRIPTION OF THE PREFERRED EMBODIMENTS

Figure 1:
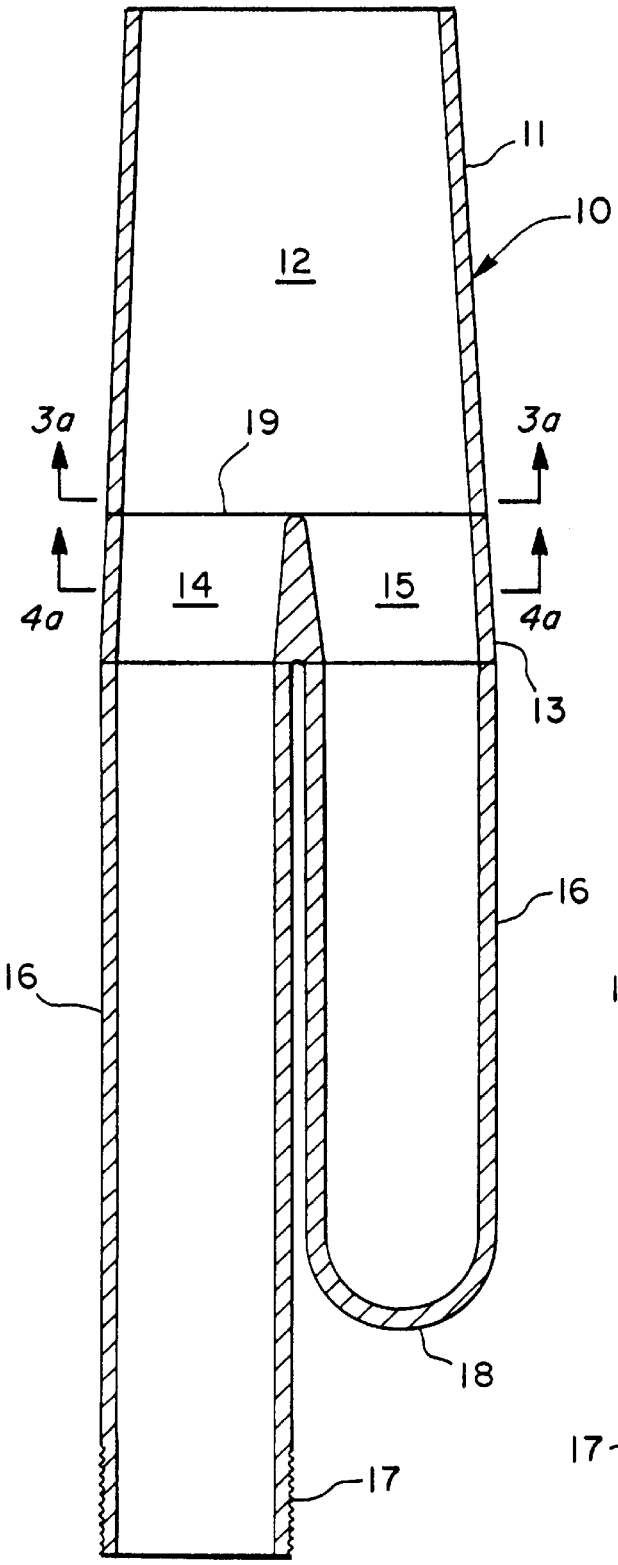
FIG. 1 is a cross sectional view of one embodiment of a template of the present invention in an expanded form.

Referring to FIG. 1, a multiple well template or guide is illustrated generally as 10 and has a generally tubular upper section 11, an intermediate body section 13, and a plurality of tubular members 16. Body section 13 is provided with two bores 14 and 15 therethrough. As secured together with the upper section, bores 14 and 15 communicate with bore 12 through tubular upper section 11 thereby defining a generally Y-shaped junction having one inlet, i.e. bore 12, and two outlets, i.e. bores 14 and 15. The upper end of body 13 defines an upper end face 19 which both bores 14 and 15 intersect. One or more tubular members 16 are secured together, aligned with bore 14 or 15 and secured to body section 13. In a like manner, one or more tubular members 16 are secured to the other bore 14 or 15. The components of the multiple well template or guide of FIG. 1 may be secured together by any suitable means as will be evident to a skilled artisan, such as by welds. One set of tubular members 16 are provided with screw threads 17 at the lower end thereof for attachment to a suitable float valve (not illustrated) while the other set of tubular members 16 are provided with a bull plug or welded cap 18. Although the tubulars 16 which are aligned with each bore 14 and 15 are generally parallel, the tubulars may be arranged so as to diverge from each other toward the bottom of the template as arranged in a well bore. If arranged to diverge, the degree of such divergence usually should not exceed 2° over the entire length of template 10, and is preferably less than 1°. In the embodiment illustrated in FIGS. 1 and 2, one set of tubular members 16 is shorter than the other set so as to provide a portion of subterranean formation between the ends of each set of tubular members within which a drill string emanating from the shorter set may be deviated so as to minimize the possibility of interference between well bores which are drilled and completed in accordance with the present invention. The sets of tubular members may also be substantially identical in length. In either embodiment, one or both sets of tubular members 16 may be provided with a whipstock(s) secured thereto to further assist in minimizing interference between the well bores drilled utilizing template 10 of the present invention.

Figure 2:
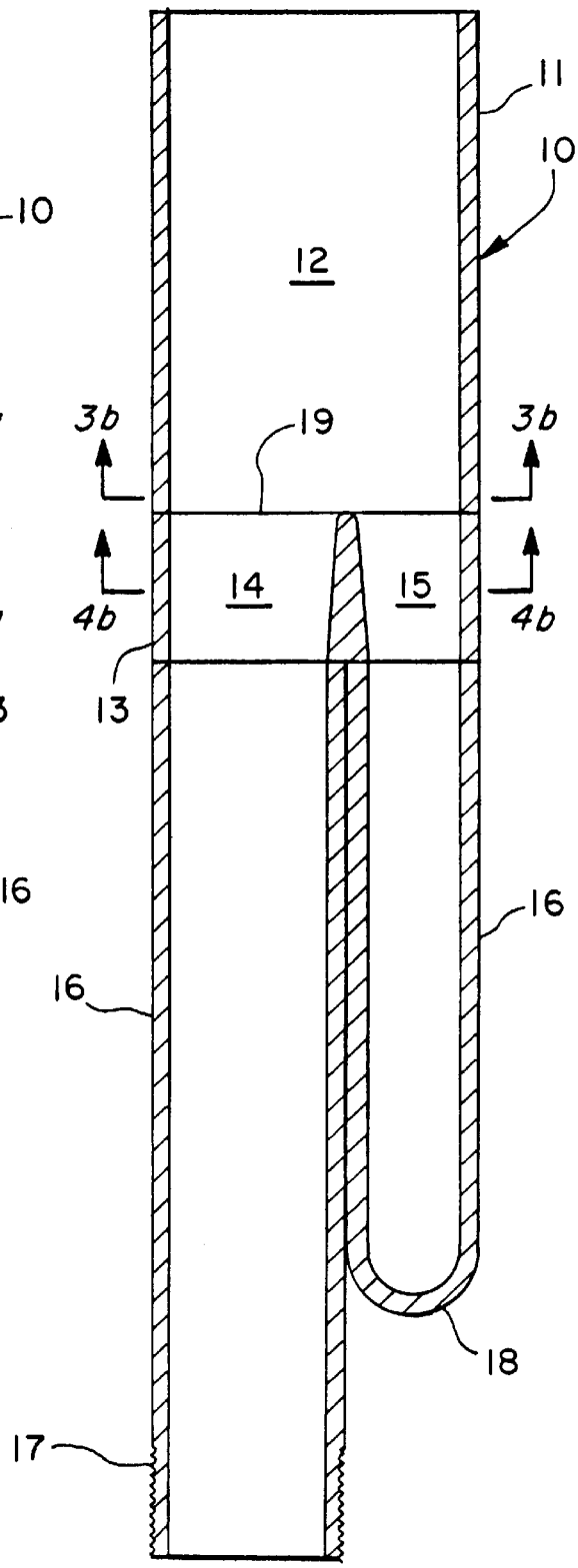
FIG. 2 is a cross sectional view of the embodiment of the template of the present invention of FIG. 1 in a deformed state for positioning in a subterranean well bore.
Figure 3A:
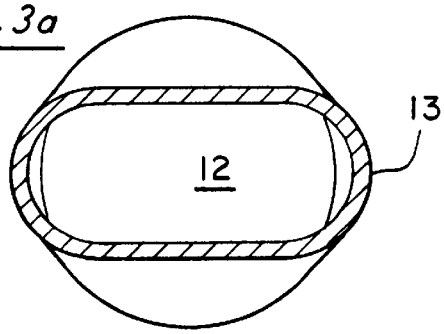
FIG. 3*a* is a sectional view of one embodiment of the template of the present invention taken along the line 3*a*—3*a* of FIG. 1.
Figure 3B:
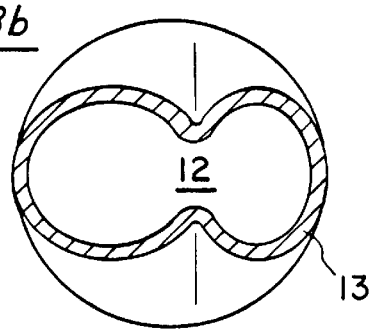
FIG. 3*b* is a sectional view of one embodiment of the template of the present invention taken along the line 3*b*—3*b* of FIG. 2.
Figure 4A:
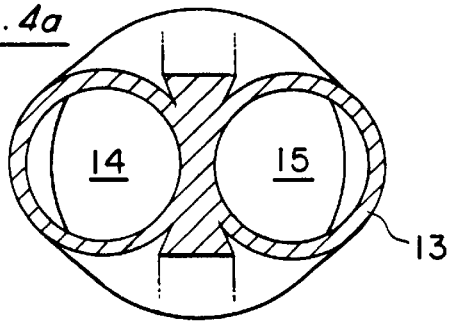
FIG. 4*a* is a sectional view of one embodiment of the template of the present invention taken along the line 4*a*—4*a* of FIG. 1.
Figure 4B:
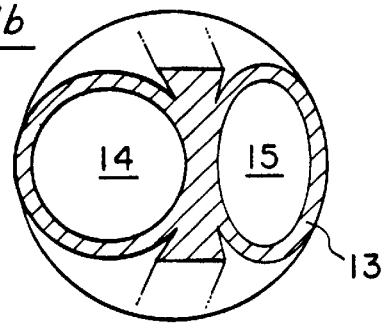
FIG. 4*b* is a sectional view of one embodiment of the template of the present invention taken along the line 4*b*—4*b* of FIG. 2.
Figure 5A:
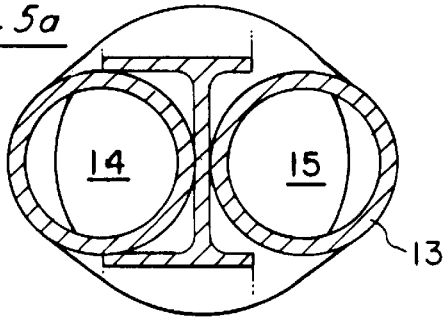
FIG. 5*a* is a sectional view of another embodiment of the body of the template of the present invention in an expanded state.
Figure 5B:
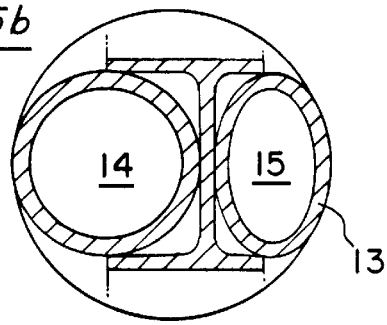
FIG. 5*b* is a sectional view of another embodiment of the body of the template of the present invention in a deformed state.
Figure 6A:
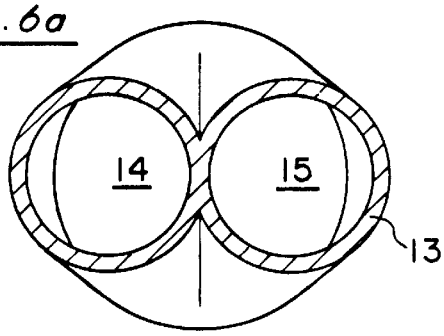
FIG. 6*a* is a sectional view of a further embodiment of the body of the template of the present invention in an expanded state.
Figure 6B:
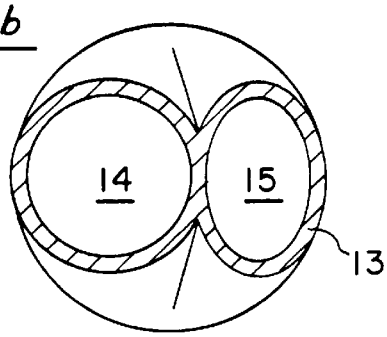
FIG. 6*b* is a sectional view of further embodiment of the body of the template of the present invention in a deformed state.
Figure 7A:
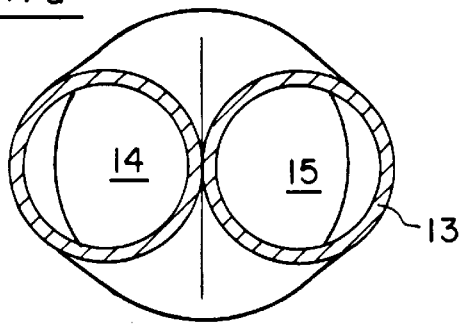
FIG. 7*a* is a sectional view of a still another embodiment of the body of the template of the present invention in an expanded state.
Figure 7B:
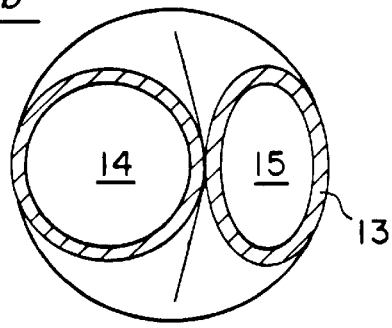
FIG. 7*b* is a sectional view of still another embodiment of the body of the template of the present invention in a deformed state.

The embodiment of the multiwell template illustrated in FIG. 1 and described above is crushed or deformed (FIG. 2) to permit passage through a subterranean well bore. As illustrated in FIG. 2, the multiwell template 10 of FIG. 2 has one side thereof, i.e. one side of upper section 11 (FIG. 3*b*), bore 15 through body section 13 (FIG. 4*b*) and the tubular members 16 having a bull plug or welded cap 18 secured to the lower end thereof crushed or deformed, while the other side remains in an expanded form. As illustrated in FIGS. 5—7*a* and *b*, the body section of the template of the present invention may have several different shapes or configurations as both constructed and deformed. The template 10 may be crushed by any suitable means, such as by using a mechanical press in conjunction with hydraulic pressure. Template 10 is constructed of metal, for example steel. Template 10 may be utilized at any point during the construction of a well, and as such, is secured to the bottom of drive pipe, conductor, surface or intermediate casing, or production or intermediate liner by any suitable means, such as welds or screw threads, for positioning in a subterranean well bore as hereafter described. Once positioned at a desired subterranean location, template 10 (FIG. 2) is initially expanded by means of hydraulic pressure and thereafter fully expanded into the form illustrated in FIG. 1 by means of mechanical swedges and/or casing rollers which may be run on drill pipe to ream the crushed side of template 10 to its original configuration as will be evident to a skilled artisan. The template of the present invention may then be employed to drill and complete multiple subterranean wells in a manner as hereinafter described. As illustrated in FIG. 1, template 10 is symmetrical as expanded, i.e. bore 12 through first section 11, bores 14 and 15 through body section 13 and the corresponding tubulars 16 depending therefrom are axially symmetrical with respect to the bore through the drive pipe, conductor, surface or intermediate casing, or production or intermediate liner from which template 10 depends.

Figure 8:
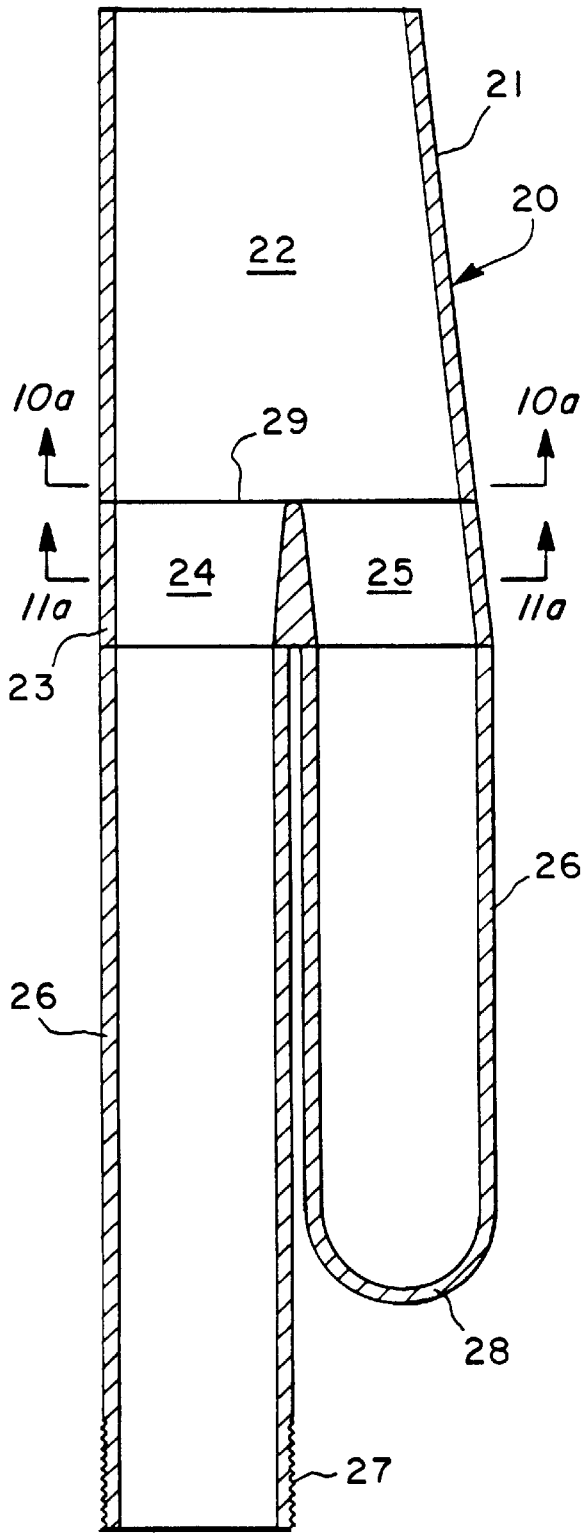
FIG. 8 is a cross sectional view of another embodiment of a template of the present invention in an expanded form.

Referring to FIG. 8, another embodiment of the template of the present invention is illustrated generally as 20 and is generally configured as template 10 with generally tubular upper section 21 corresponding to 11, intermediate body section 23 and bores 24 and 25 to 13, 14 and 15, and a plurality of tubular members 26 to 16 of template 10. The upper end of body 23 defines an upper end face 29 which both bores 24 and 25 intersect. However, bore 25 and the portion of bore 22 through upper tubular 21 and the members 26 aligned with and depending from bore 25 are all axially offset as expanded (FIGS. 8, 10*a*, and 11*a*). This axially offset portion of template 20 is deformed or crushed (FIGS. 9, 10*b* and 11*b*) for positioning template 20 within a subterranean well bore as hereafter described.

Figure 12B:
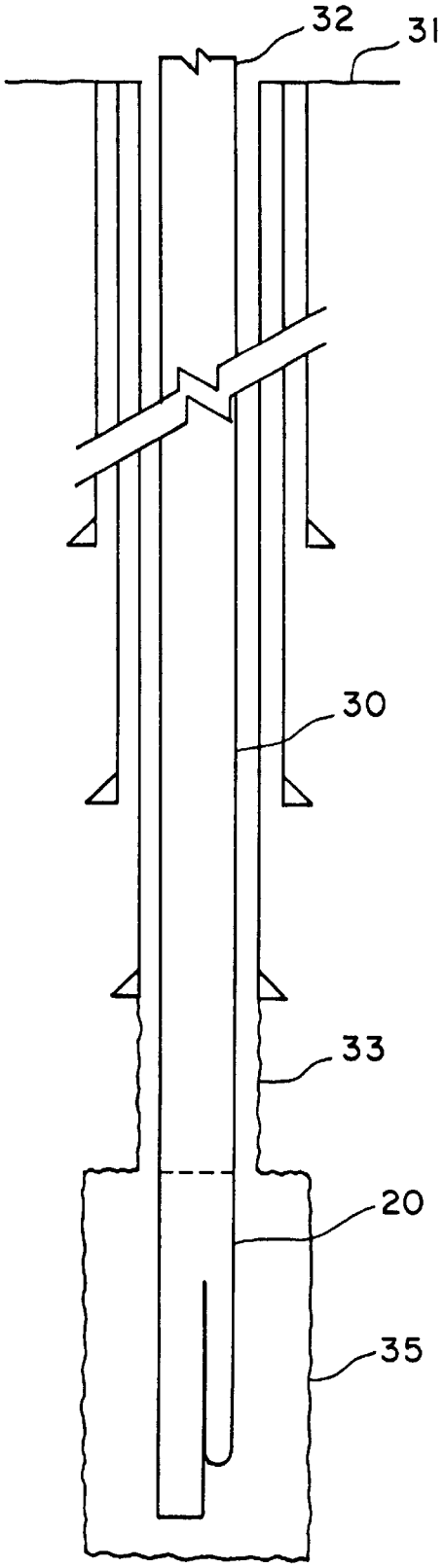
FIGS. 12*a*–12*g* are schematic views of the downhole template of the present invention which is illustrated in FIGS. 8 and 9 as utilized to drill and complete multiple subterranean wells in accordance with the process of the present invention.
Figure 12A:
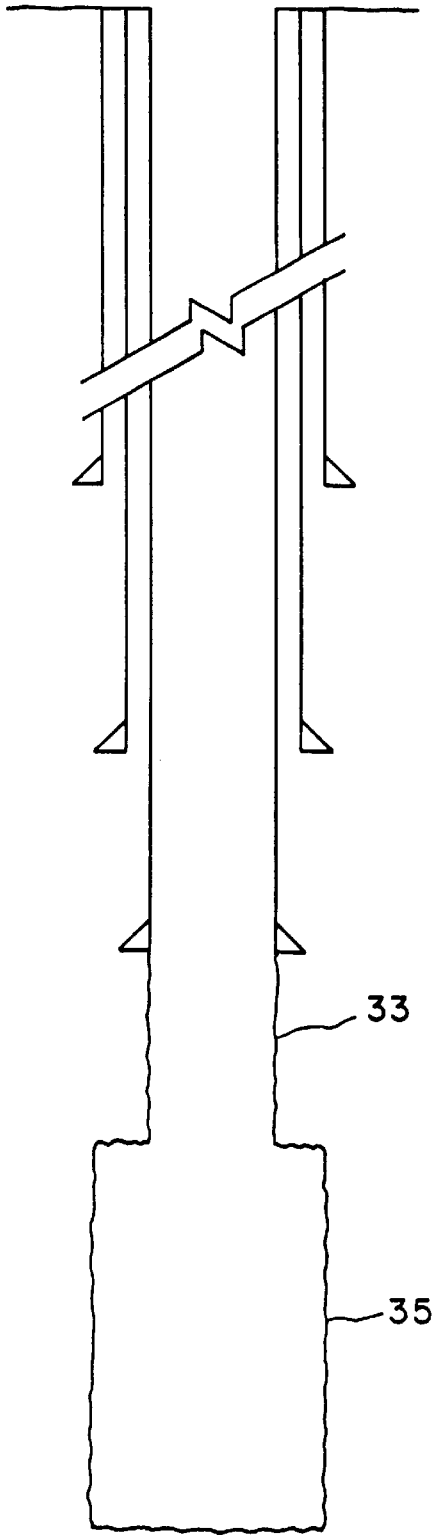
Figure 12C:
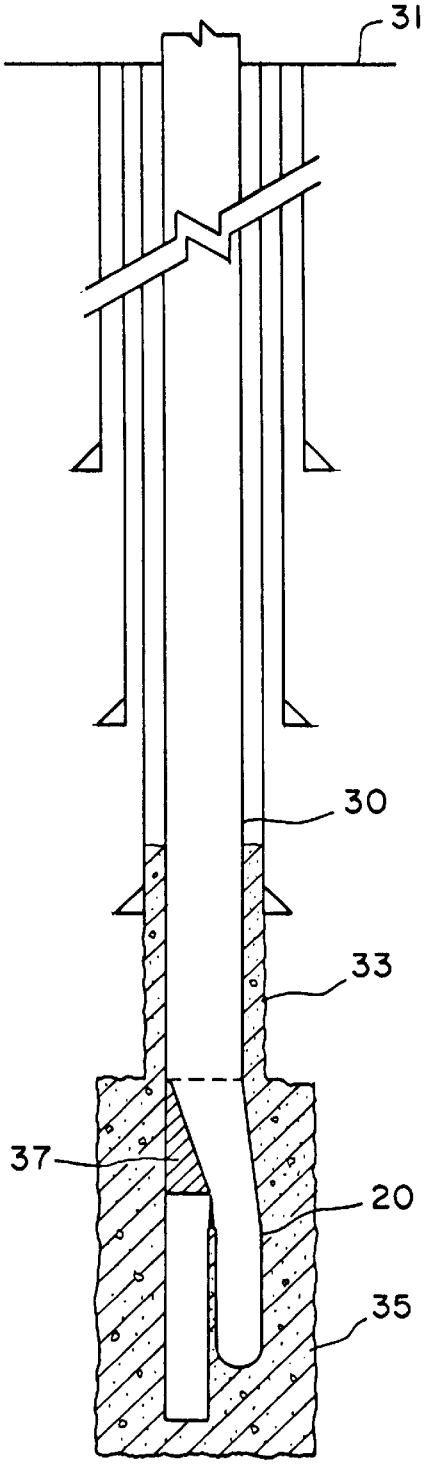

In operation, a well bore 33 is under reamed by means of an under reamer to form an enlarged section 35 into which template 20 may be subsequently positioned and expanded (FIG. 12*a*). Template 20 is deformed to the configuration illustrated in FIG. 9 and is secured to the bottom of surface or intermediate casing 30 by any suitable means, such as welds or screw threads. As illustrated in FIG. 12*b*, surface or intermediate casing 30 with template 20 secured to the bottom thereof is positioned within a well bore 33 and 35. Well bore 33 can be generally vertical or deviated. Surface or intermediate casing 30 extends to the surface of the earth 31 thereby defining a well head. In accordance with the present invention, template 20 is expanded (FIG. 12*c*) by means of hydraulic pressure and a mechanical swedge(s) and/or casing roller(s) to the form illustrated in FIG. 9. Once expanded the template and casing can be cemented in place. A whipstock or orienting cam 37 is sealingly positioned within bore 24 of body section 23 of template 20 and automatically oriented such as by a lug or key arrangement as will be evident to a skilled artisan so that the inclination of the whipstock or orienting cam functions to guide a drill string into bore 25.

Figure 12D:
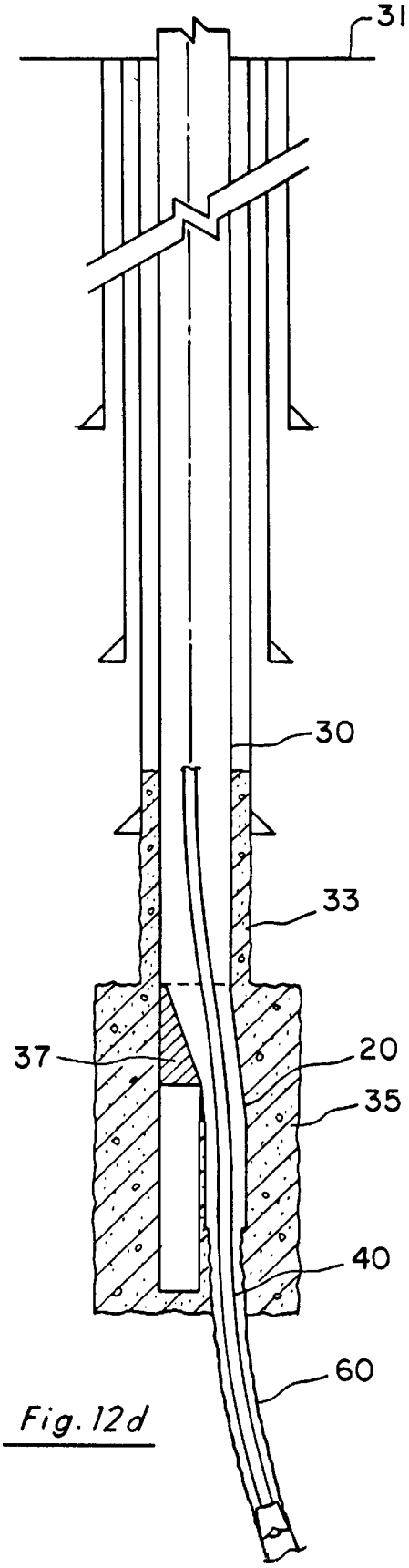
Figure 12E:
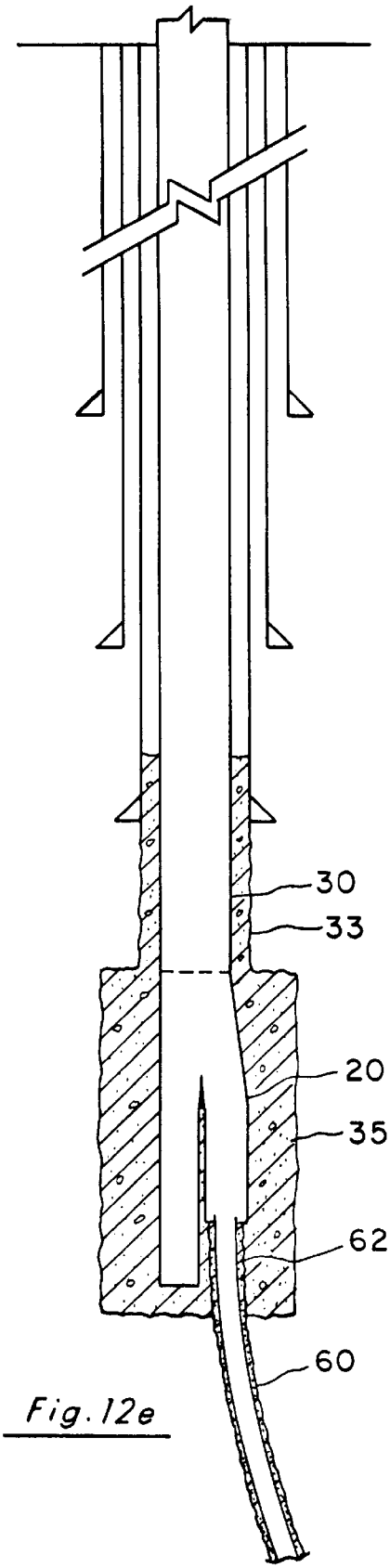
Figure 12F:
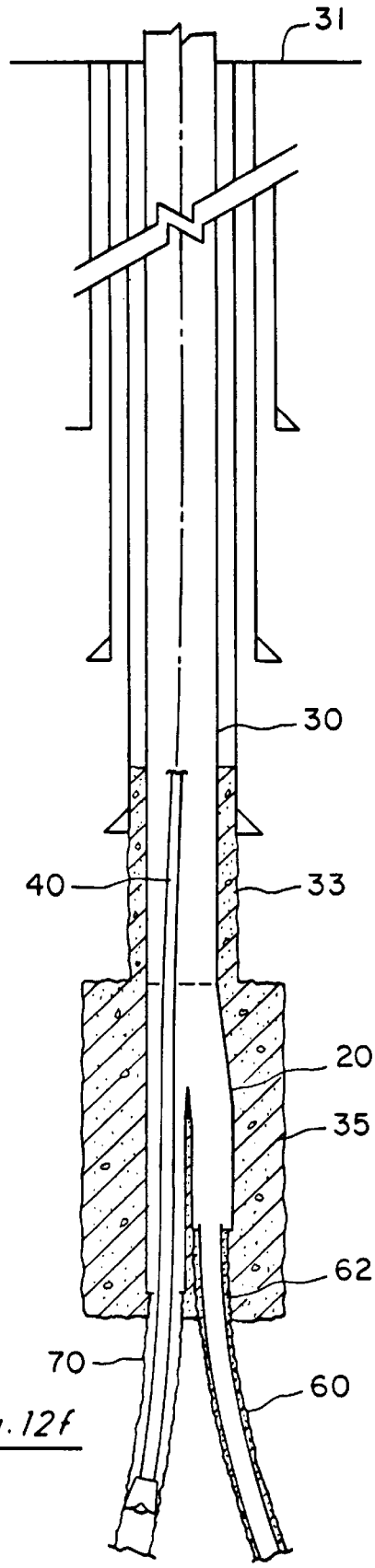
Figure 12G:
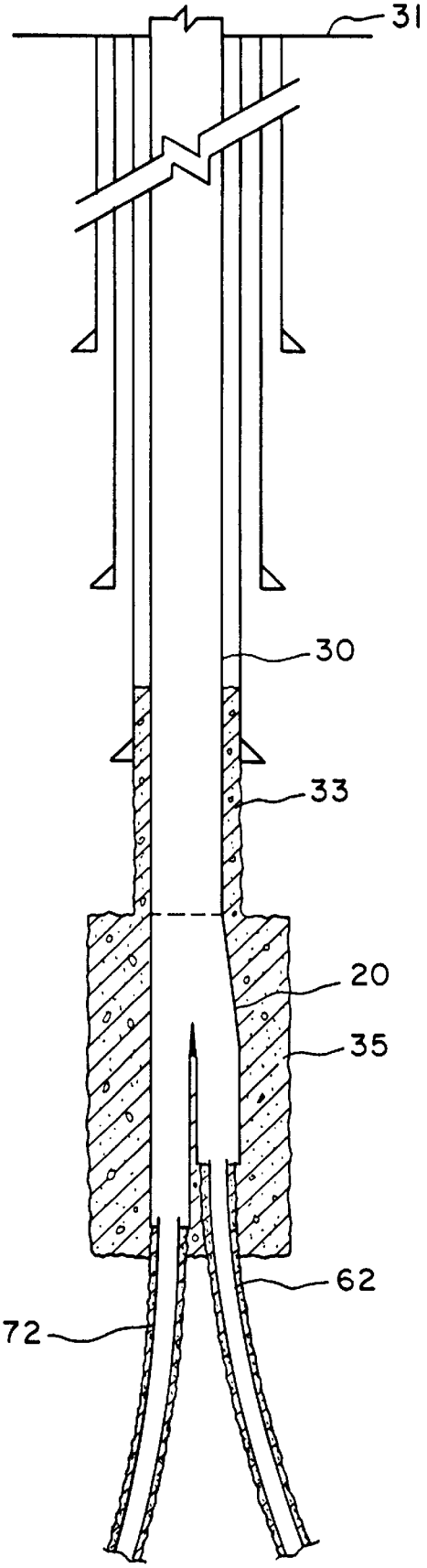

A conventional drill string 40 including a drill bit and mud motor (FIG. 12*d*) is transported within casing 30 and into bore 25 of template 20 whereupon plug 28 and cement, if any, is drilled out of tubulars 26. Thereafter, a first well bore 60 is drilled by the drill string in a conventional manner as will be evident to the skilled artisan with drilling mud and formation cuttings being circulated out of well bore 60 to surface 31 and through tubulars 26 and bores 25 and 22 in the template and casing 30 to the surface. Although illustrated in FIG. 12*d* as deviated, first well bore 60 can also be drilled in a generally vertical orientation. Thereafter, the drill string is withdrawn from casing 30 and liner 62 is lowered through casing 30 and is secured to template 20 (FIG. 12*e*) by means of conventional liner hanger. The liner hanger may also be seated upon and supported by a profile, e.g. annular shoulder, formed within bore 25 or tubulars 26. The liner hanger includes an expandable packer to seal the annulus between the liner hanger and bore 25 or tubulars 26 and expandable slips to assist in securing the hanger within bore 25 or tubulars 26. Depending upon the total load supported by a profile within bore 25, slips may not be needed to assist in supporting such load. Liner 62 can be cemented within first well bore 60. The whipstock 37 is then withdrawn from bore 24. Since template 20 is asymmetrical as expanded, bore 24 is essentially aligned with casing 30 so that a whipstock or orienting cam is not necessary to divert a drill string therein. In the instance where the template of the present invention is symmetrical as expanded, it will be necessary to rotate and insert the whipstock or orienting cam 37 into bore 25 of template 20. A drill string 40 is then transported via casing 30 into bore 24 and the float equipment which is secured to the lower end of tubulars 26 is drilled out. The drill string is passed through bore 24 and a second well bore 70 is drilled. Although illustrated in FIG. 12*f* as deviated, second well bore 70 can also be drilled in a generally vertical orientation, usually if first well bore 60 was deviated. Thereafter, the drill string is withdrawn from casing 30 and liner 72 is lowered through casing 30 and is secured to template 20 (FIG. 12*g*) by means of conventional liner hanger as described above. Liner 72 can be cemented within second well bore 70 as will be evident to the skilled artisan. The template of the present invention can be utilized during drilling of wells from onshore drilling rigs and/or offshore drilling platforms. As thus completed in accordance with the present invention, fluids, such as hydrocarbons, are simultaneously produced from both wells 60 and 70 via liners 62 and 72, respectively, and commingled for production to the surface via casing 30 or tubing positioned within the casing 30 or separately produced to the surface using dual tubing strings as will be evident to a skilled artisan.

Figure 13:
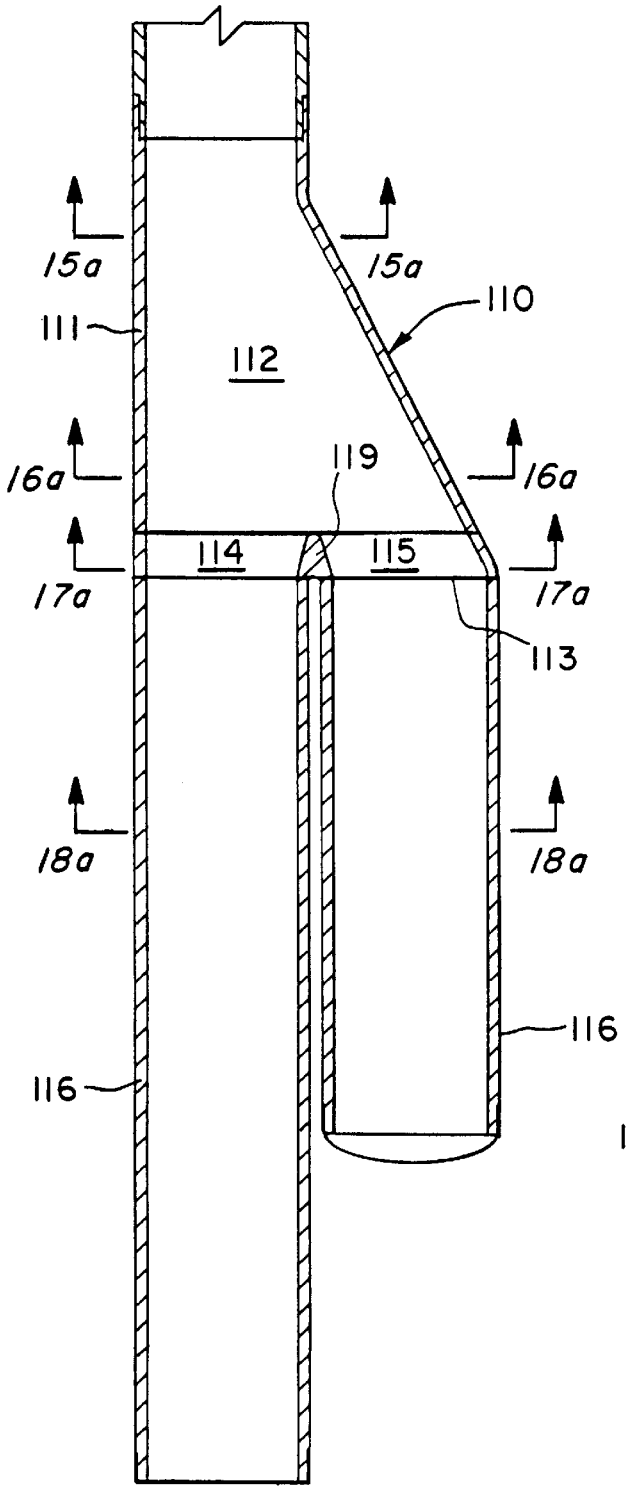
FIG. 13 is a cross sectional view of still another embodiment of a template of the present invention in an expanded form.

Although the template of the present invention has been described above and illustrated in FIGS. 1–12 as having only one side or portion thereof deformed or crushed, the template may have both sides including tubular members deformed or crushed. In FIG. 13, a multiple well template or guide is illustrated generally as 110 and has a generally tubular upper section 111, an intermediate body section 113, and a plurality of tubular members 116. Body section 113 is provided with two bores 114 and 115 therethrough and has an upper end face 119 which both bores intersect. As secured together with the upper section bores 114 and 115 communicate with bore 112 through tubular upper section 111 thereby defining a generally Y-shaped junction having one inlet, i.e. bore 112, and two outlets, i.e. bores 114 and 115. One or more tubular members 116 are secured together, aligned with bore 114 or 115 and secured to body section 113. In a like manner, one or more tubular members 116 are secured to the other bore 114 or 115. The components of the multiple well template or guide of FIG. 13 may be secured together by any suitable means as will be evident to a skilled artisan, such as by welds or screw threads. One set of tubular members 116 is provided with a float valve (not illustrated) while the other set of tubular members 116 are provided with a bull plug or welded cap 118. If arranged to diverge, the degree of such divergence of the sets of tubular members 116 usually should not exceed 2° over the entire length of template 110, and is preferably less than 1°. In the embodiment illustrated in FIGS. 13 and 14, one set of tubular members 116 is shorter than the other set so as to provide a portion of subterranean formation between the ends of each set of tubular members within which a drill string emanating from the shorter set may be deviated so as to minimize the possibility of interference between well bores which are drilled and completed in accordance with the present invention. The sets of tubular members may also be substantially identical in length. In either embodiment, one or both sets of tubular members 116 may be provided with a whipstock(s) secured thereto to further assist in minimizing interference between the well bores drilled utilizing template 110 of the present invention.

Figure 9:
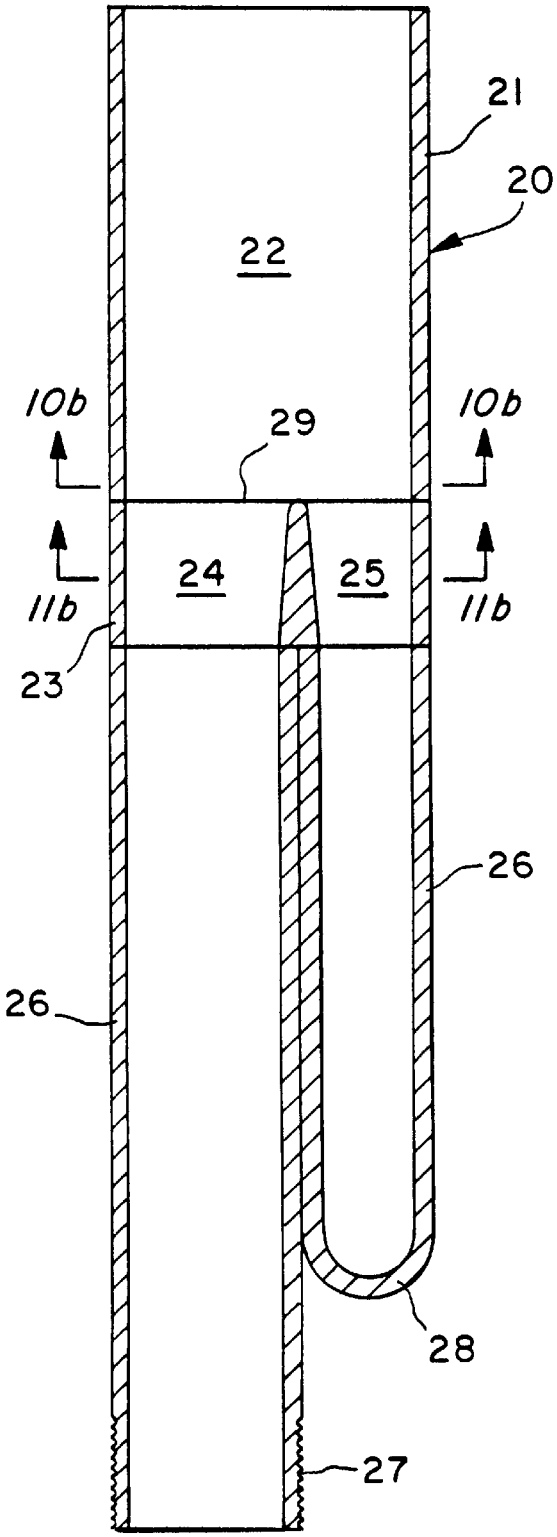
FIG. 9 is a cross sectional view of the embodiment of the template of the present invention of FIG. 8 in a deformed state for positioning in a subterranean well bore.
Figure 14:
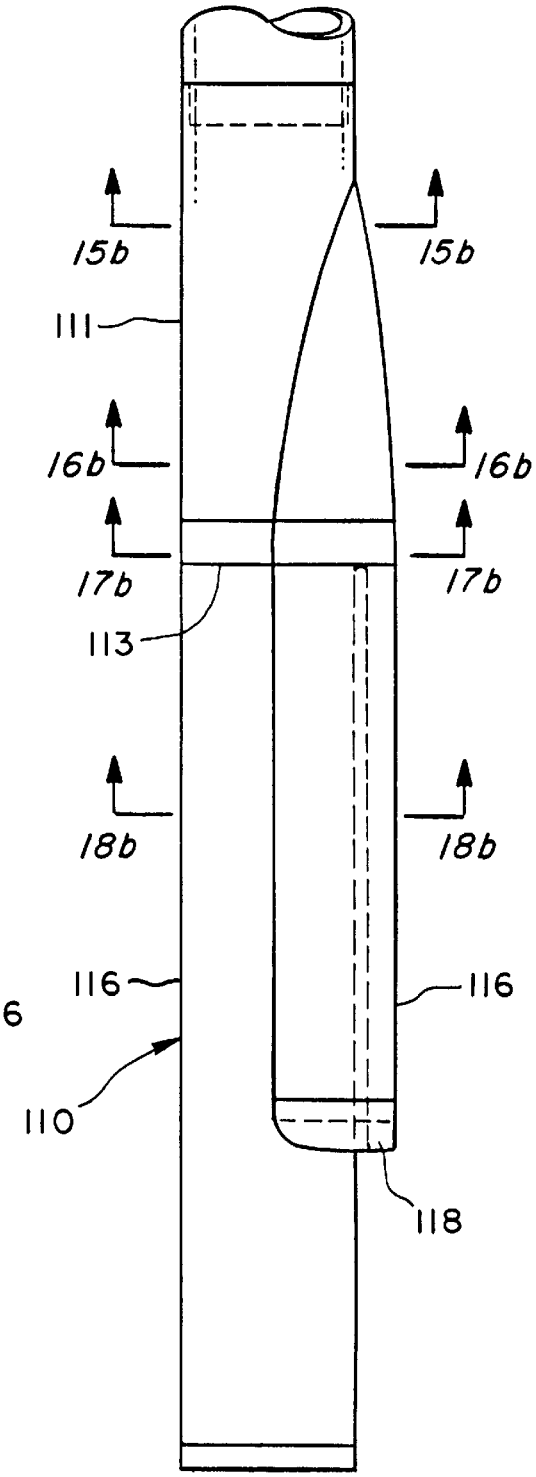
FIG. 14 is a cross sectional view of the embodiment of the template of the present invention of FIG. 13 in a deformed state for positioning in a subterranean well bore.
Figure 15A:
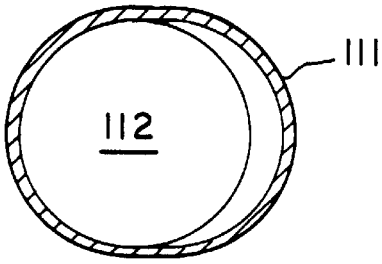
FIG. 15*a* is a sectional view of the embodiment of the template of the present invention taken along the line 15*a*—15*a* of FIG. 13.
Figure 15B:
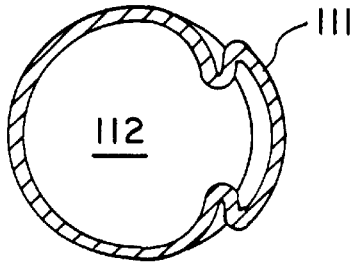
FIG. 15*b* is a perspective view of the embodiment of the template of the present invention taken along the line 15*b*—15*b* of FIG. 14.
Figure 16A:
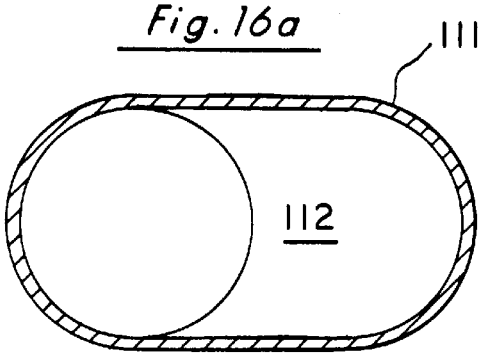
FIG. 16*a* is a sectional view of the embodiment of the template of the present invention taken along the line 16*a*—16*a* of FIG. 13.
Figure 16B:
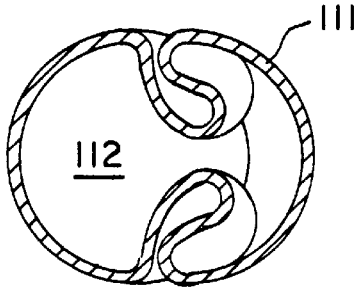
FIG. 16*b* is a sectional view of the embodiment of the template of the present invention taken along the line 16*b*—16*b* of FIG. 14.
Figure 17A:
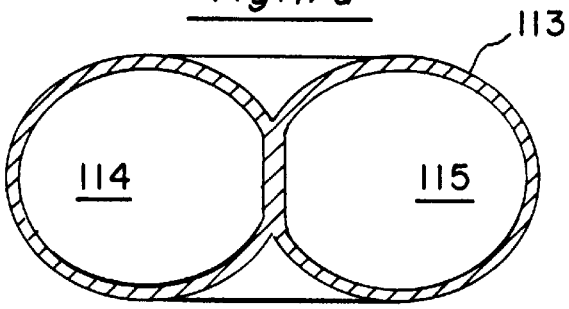
FIG. 17*a* is a sectional view of the embodiment of the template of the present invention taken along the line 17*a*—17*a* of FIG. 13.
Figure 17B:
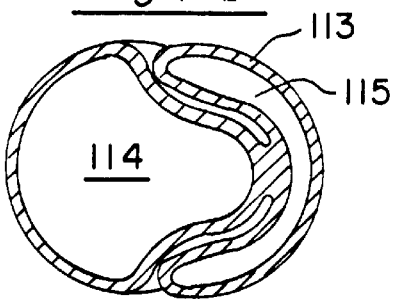
FIG. 17*b* is a sectional view of the embodiment of the template of the present invention taken along the line 17*b*—17*b* of FIG. 14.
Figure 18A:
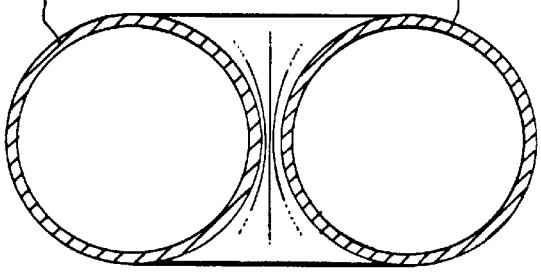
FIG. 18*a* is a sectional view of the embodiment of the template of the present invention taken along the line 18*a*—18*a* of FIG. 13.
Figure 18B:
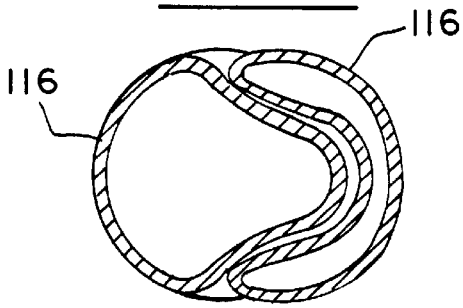
FIG. 18*b* is a sectional view of the embodiment of the template of the present invention taken along the line 18*b*—18*b* of FIG. 14.

The embodiment of the multiwell template illustrated in FIG. 13 and described above is crushed or deformed (FIG. 14) to permit passage through a subterranean well bore. As illustrated in FIG. 14, the multiwell template 110 of FIG. 13 has both sides thereof crushed or deformed, i.e. both sides of upper section 111 (FIGS. 15*b* and 16*b*), bores 114 and 115 through body section 113 (FIG. 17*b*) and the tubular members 116 (FIG. 18*b*). As illustrated in FIGS. 14, 15*b*, 16*b*, 17*b* and 18*b*, that portion of the deformed multiwell template 110 which is crushed or deformed has a diameter which is larger than the diameters of either the remaining portion of the template which is not crushed or deformed or the casing or other tubular to which it is secured. As illustrated in FIGS. 5–7*a* and *b*, the body section 113 of template 110 of the present invention may have several different shapes or configurations as both constructed and deformed. The template 10 may be crushed by any suitable means, such as by using a mechanical press in conjunction with hydraulic pressure. Template 110 is constructed of metal, for example steel. Template 110 may be utilized at any point during the construction of a well, and as such, is secured to the bottom of drive pipe, conductor, surface or intermediate casing, or production or intermediate liner by any suitable means, such as welds, for positioning in a subterranean well bore as hereafter described. Once positioned at a desired subterranean location, template 110 (FIG. 14) is initially expanded by means of hydraulic pressure and thereafter fully expanded into the form illustrated in FIG. 13 by means of mechanical swedges and/or casing rollers which may be run on drill pipe to ream the crushed side of template 10 to its original configuration as will be evident to a skilled artisan. The template 110 of the present invention may then be employed to drill and complete multiple subterranean wells in a manner as described above and illustrated in FIGS. 12*a–g* with respect to template 20 (FIGS. 8 and 9). As illustrated in FIG. 14, template 110 is asymmetrical as expanded, i.e. bore 112 through first section 111, bore 115 through body section 113 and the corresponding tubulars 116 depending therefrom are axially offset with respect to the bore through the drive pipe, conductor, surface or intermediate casing, or production or intermediate liner from which template 110 depends.

Figure 19:
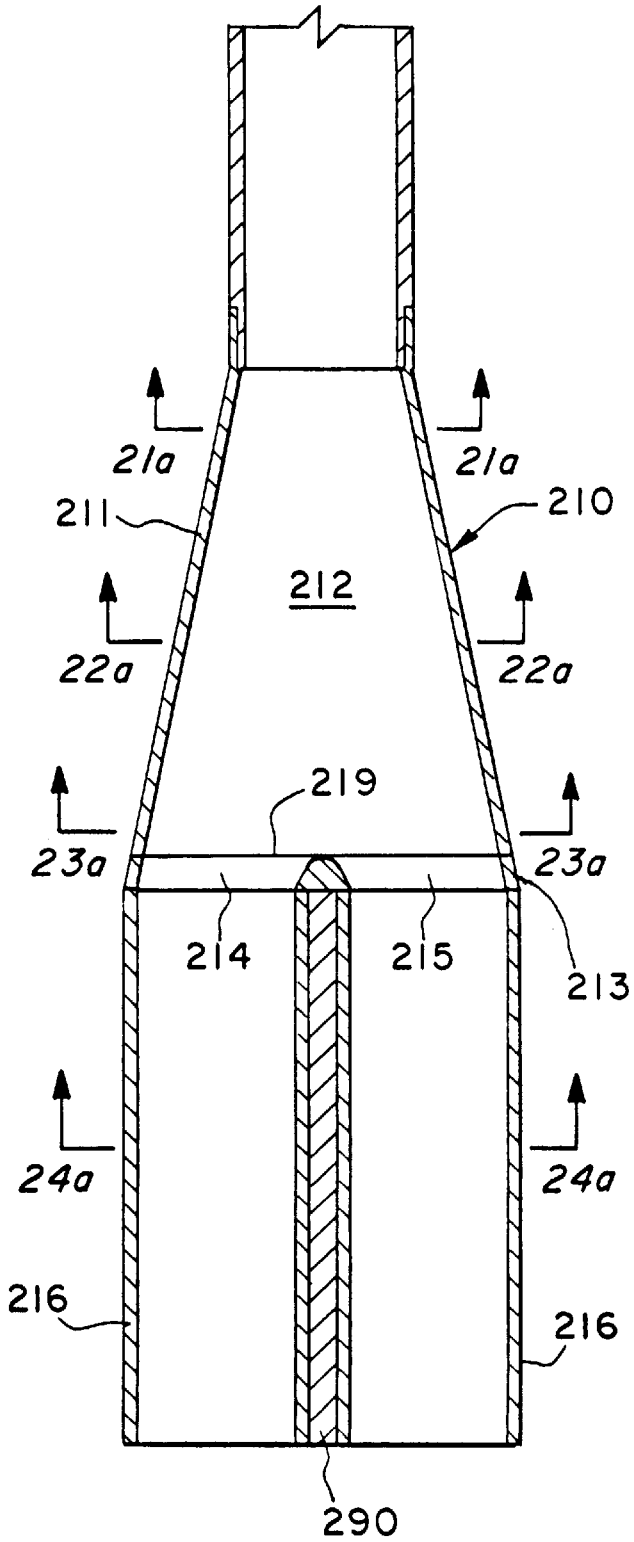
FIG. 19 is a cross sectional view of a further embodiment of a template of the present invention in an expanded form.

Another embodiment of the multiple well template or guide is illustrated in FIG. 19 generally as 210 and has a generally tubular upper section 211, an intermediate body section 213, and a plurality of tubular members 216. Body section 213 is provided with two bores 214 and 215 therethrough and has an upper end face 219 which both bores intersect. As secured together with the upper section bores 214 and 215 communicate with bore 212 through tubular upper section 211 thereby defining a generally Y-shaped junction having one inlet, i.e. bore 212, and two outlets, i.e. bores 214 and 215. One or more tubular members 216 are secured together, aligned with bore 214 or 215 and secured to body section 213. In a like manner, one or more tubular members 216 are secured to the other bore 214 or 215. The components of the multiple well template or guide of FIG. 19 may be secured together by any suitable means as will be evident to a skilled artisan, such as by welds. One set of tubular members 216 is provided with a float valve (not illustrated) while the other set of tubular members 216 are provided with a bull plug or welded cap 218. If arranged to diverge, the degree of such divergence of the sets of tubular members 216 usually should not exceed 2° over the entire length of template 210, and is preferably less than 1°. In the embodiment illustrated in FIGS. 19 and 20, one set of tubular members 216 is shorter than the other set so as to provide a portion of subterranean formation between the ends of each set of tubular members within which a drill string emanating from the shorter set may be deviated so as to minimize the possibility of interference between well bores which are drilled and completed in accordance with the present invention. The sets of tubular members may also be substantially identical in length. In either embodiment, one or both sets of tubular members 216 may be provided with a whipstock(s) secured thereto to further assist in minimizing interference between the well bores drilled utilizing template 210 of the present invention.

Figure 20:
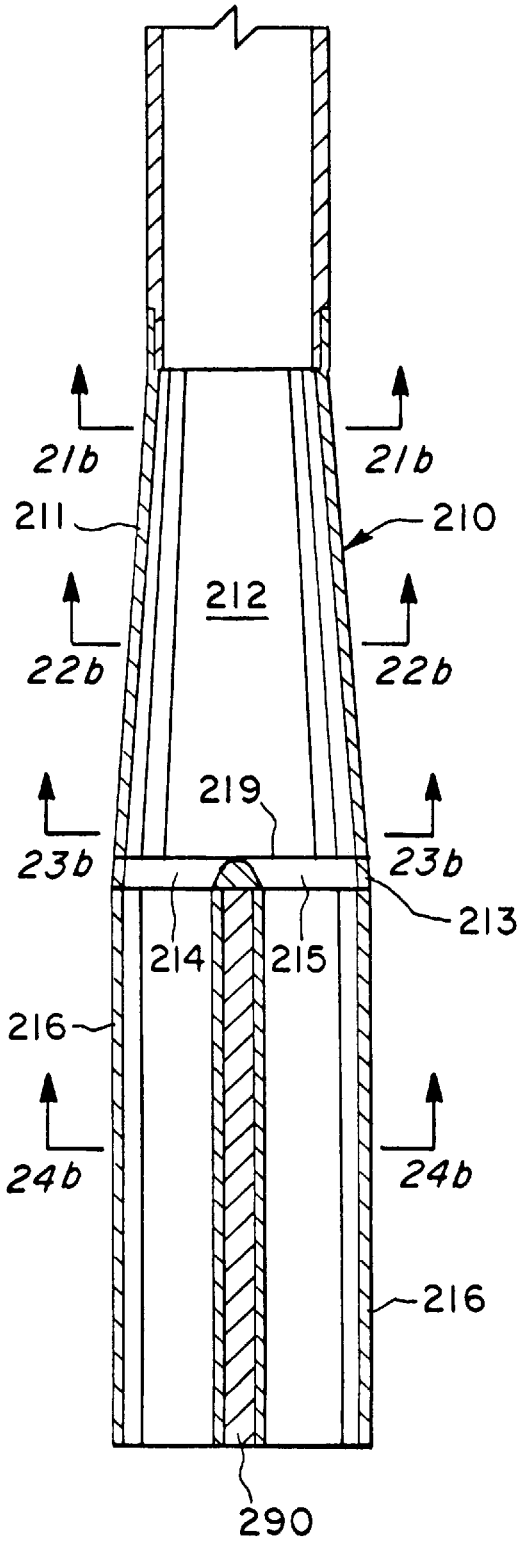
FIG. 20 is a cross sectional view of the embodiment of the template of the present invention of FIG. 19 in a deformed state for positioning in a subterranean well bore.
Figure 21A:
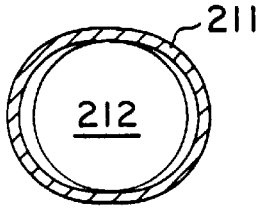
FIG. 21*a* is a sectional view of the embodiment of the template of the present invention taken along the line 21*a*—21*a* of FIG. 19.
Figure 21B:
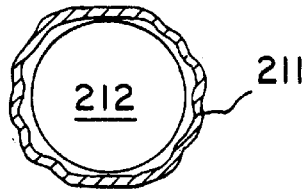
FIG. 21*b* is a sectional view of the embodiment of the template of the present invention taken along the line 21*b*—21*b* of FIG. 20.
Figure 22A:
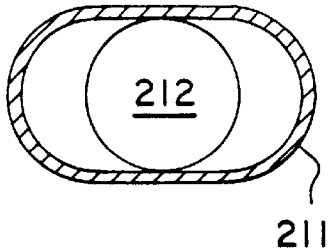
FIG. 22*a* is a sectional view of the embodiment of the template of the present invention taken along the line 22*a*—22*a* of FIG. 19.
Figure 22B:
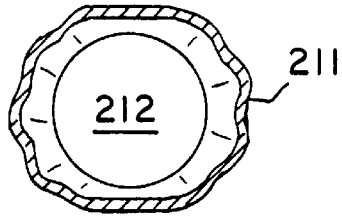
FIG. 22*b* is a sectional view of the embodiment of the template of the present invention taken along the line 22*b*—22*b* of FIG. 20.
Figure 23A:
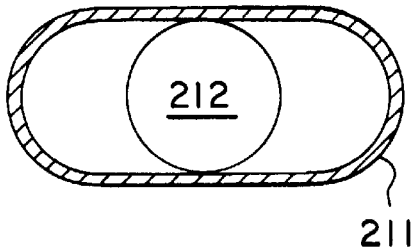
FIG. 23*a* is a sectional view of the embodiment of the template of the present invention taken along the line 23*a*—23*a* of FIG. 19.
Figure 23B:
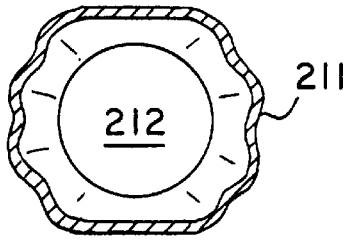
FIG. 23*b* is a sectional view of the embodiment of the template of the present invention taken along the line 23*b*—23*b* of FIG. 20.
Figure 24A:
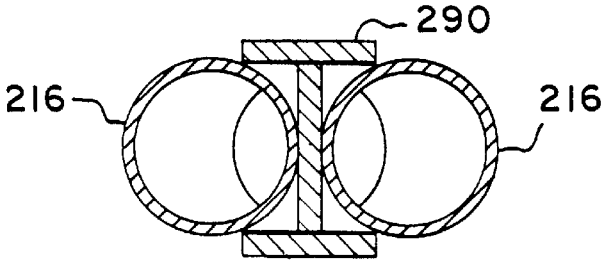
FIG. 24*a* is a sectional view of the embodiment of the template of the present invention taken along the line 24*a*—24*a* of FIG. 19.
Figure 24B:
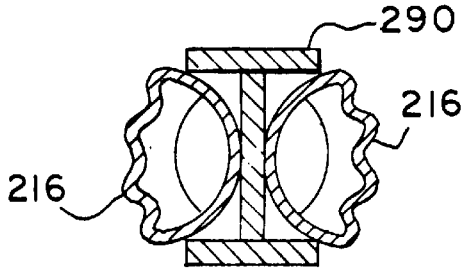
FIG. 24*b* is a sectional view of the embodiment of the template of the present invention taken along the line 24*b*—24*b* of FIG. 20.
Figure 25A:
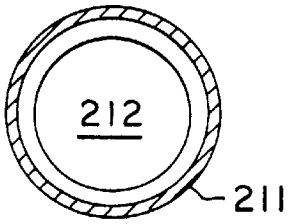
FIG. 25*a* is a sectional view of an alternative embodiment of the template of the present invention taken along the line 21*a*—21*a* of FIG. 19.
Figure 25B:
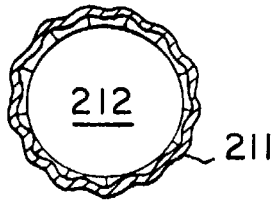
FIG. 25*b* is a sectional view of an alternative embodiment of the template of the present invention taken along the line 21*b*—21*b* of FIG. 20.
Figure 26A:
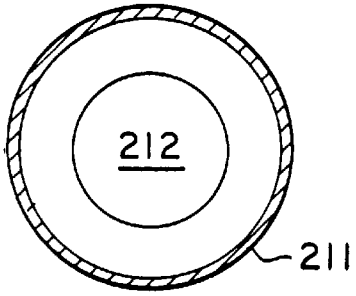
FIG. 26*a* is a sectional view of an alternative embodiment of the template of the present invention taken along the line 22*a*—22*a* of FIG. 19.
Figure 26B:
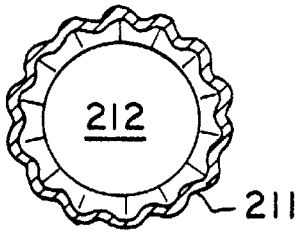
FIG. 26*b* is a sectional view of an alternative embodiment of the template of the present invention taken along the line 22*b*—22*b* of FIG. 20.
Figure 27A:
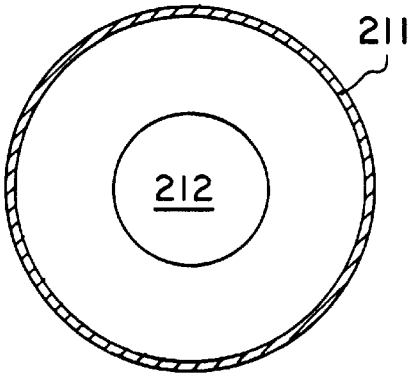
FIG. 27*a* is a sectional view of an alternative embodiment of the template of the present invention taken along the line 23*a*—23*a* of FIG. 19.
Figure 27B:
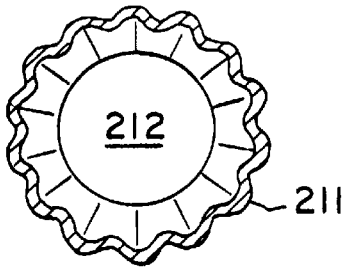
FIG. 27*b* is a sectional view of an alternative embodiment of the template of the present invention taken along the line 23*b*—23*b* of FIG. 20.
Figure 28A:
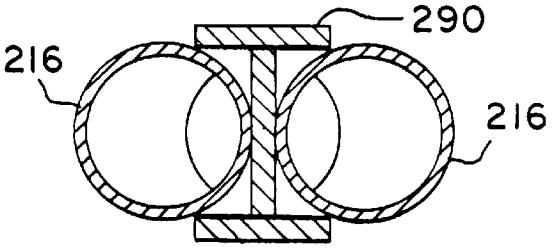
FIG. 28*a* is a sectional view of an alternative embodiment of the template of the present invention taken along the line 24*a*—24*a* of FIG. 19.
Figure 28B:
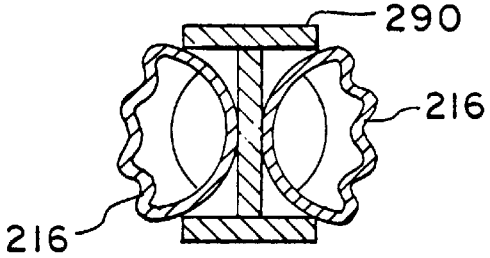
FIG. 28*b* is a sectional view of an alternative embodiment of the template of the present invention taken along the line 24*b*—24*b* of FIG. 20.

The embodiment of the multiwell template illustrated in FIG. 19 and described above is crushed or deformed (FIG. 20) to permit passage through a subterranean well bore. As illustrated in FIG. 20, the multiwell template 210 of FIG. 19 has both sides thereof crushed or deformed, i.e. both sides of upper section 211 (FIGS. 21*b* and 22*b*), bores 214 and 215 through body section 213 (FIG. 23*b*) and the tubular members 216 (FIG. 24*b*). As illustrated in FIGS. 25–28*a* and *b*, the body section 213 of template 210 of the present invention may have several different shapes or configurations as both constructed and deformed. As illustrated in FIGS. 20, 21*b*, 22*b*, 23*b* and 24*b* and FIGS. 25*b*, 26*b*, 27*b* and 28*b* , that portion of the deformed multiwell template 210 which is crushed or deformed has a diameter which is larger than the diameters of either the remaining portion of the template which is not crushed or deformed or the casing or other tubular to which it is secured. The template 210 may be crushed by any suitable means, such as by using a mechanical press in conjunction with hydraulic pressure. Template 210 is constructed of metal, for example steel. Template 210 may be utilized at any point during the construction of a well, and as such, is secured to the bottom of drive pipe, conductor, surface or intermediate casing, or production or intermediate liner by any suitable means, such as welds, for positioning in a subterranean well bore as hereafter described. Once positioned at a desired subterranean location, template 210 (FIG. 20) is initially expanded by means of hydraulic pressure and thereafter fully expanded into the form illustrated in FIG. 19 by means of mechanical swedges and/or casing rollers which may be run on drill pipe to ream the crushed side of template 210 to its original configuration as will be evident to a skilled artisan. The template 210 of the present invention may then be employed to drill and complete multiple subterranean wells in a manner as described above and illustrated in FIGS. 12*a–g* with respect to template 20 (FIGS. 8 and 9). As illustrated in FIG. 19, template 210 is symmetrical as expanded, i.e. bore 212 through first section 211, bores 214 and 215 through body section 213 and the corresponding tubulars 216 depending therefrom are symmetrical with respect to the bore through the drive pipe, conductor, surface or intermediate casing, or production or intermediate liner from which template 210 depends.

The following example demonstrates the practice and utility of the present invention, but is not to be construed as limiting the scope thereof.

EXAMPLE

A drilling rig is skidded over a slot on a conventional offshore drilling plafform and a 36 inch diameter bore is drilled from mudline to 400 feet. A 30 inch diameter casing is positioned within the bore and is conventionally cemented therein. A drill string with a 26 inch drill bit is inserted within the 30 inch casing and a 26 inch diameter bore is drilled from 450 feet to a 2500 foot depth. A 20 inch diameter casing string is run to 2500 feet and cemented. A 17½ inch diameter bore is drilled from 2500 feet to 4,500 feet and a 13⅜ inch diameter casing is run to 4,500 feet and cemented. A 12¼ inch diameter bore is drilled from 4,500 feet to 12,000 feet and the bore is under reamed to a 24 inch diameter from 11,940 feet to 12,000 feet. A 9⅝ inch diameter casing having one embodiment of the deformed template of the present invention secured to the lowermost joint thereof is positioned within the 24 inch well bore and the 9⅝ inch casing is secured to the well head equipment. The deformed template is expanded by means of hydraulic pressure and a mechanical swedge such that the tubulars thereof are 7 inches in diameter. Once expanded the template and 9⅝ inch diameter casing are cemented in place. A whipstock or orienting cam is sealingly positioned within one bore of body section of the template. A conventional drill string including a drill bit and mud motor is transported within the 9⅝ inch casing and guided by the whipstock through one bore of the template to drilled the cement out of tubulars of the template. Thereafter, a first well bore is drilled to 15,000 feet by the drill string in a conventional manner as will be evident to the skilled artisan. The drill string is then withdrawn from the 9⅝ inch casing and a liner is lowered through the 9⅝ inch casing into the first well bore and is secured to the template by means of a conventional liner hanger. The liner is cemented within the first well bore. The whipstock is then withdrawn from bore of the template to the surface and the drill string is then transported via the 9⅝ inch casing into the other bore through the template and the float equipment which is secured to the lower end of tubulars of the template is drilled out. The drill string is passed through this bore and a second well bore is drilled to 16,000 feet. Thereafter, the drill string is withdrawn from the 9⅝ inch casing and a liner is lowered into the second well bore and is secured to the template by means of conventional liner hanger. The liner is then cemented within the second well bore.

Although described above as being secured to the bottom of drive pipe, conductor, surface or intermediate casing, or production or intermediate liner by any suitable means, such as welds, the template can be equipped with a conventional packer assembly (not illustrated) which is positioned about and secured to the periphery of the template, preferably at the upper end thereof as positioned within a well bore. The packer assembly comprises a plurality of expandable, annular elastomeric elements and a plurality of slip elements. In this embodiment, the template is sized to be received within the drive pipe, conductor, surface or intermediate casing, or production or intermediate liner, and thus, can be lowered by means of a drill string, tubing string, or wireline (not illustrated) within the drive pipe, conductor, surface or intermediate casing, or production or intermediate liner. Once positioned near the lowermost end of drive pipe, conductor, surface or intermediate casing, or production or intermediate liner, the slips and packer elements are sequentially expanded into engagement with drive pipe, conductor, surface or intermediate casing, or production or intermediate liner in a manner and by conventional means as will be evident to a skilled artisan so as to secure the template within drive pipe, conductor, surface or intermediate casing, or production or intermediate liner and seal the annulus therebetween. The slips are sized and configured to support not only the template, but also production casings.

Although the multiple well template of the present invention has been illustrated and described as having two bores therethrough, it will be evident to a skilled artisan that the template can be provided with three or more bores depending upon the diameter of the bore into which the template is positioned and the diameter of the well bores to be drilled using the template.

Although described throughout this description as being separately utilized in the process of the present invention, downhole or subsurface templates 10, 20, 110 or 210 can be secured to at least one tubular of a surface template to drill two or more separate subterranean wells from each of tubular of a surface template. Additionally, the templates of the present invention may be stacked, for example a template may be secured to the long tubular of another template, or the template of the present invention may be secured to the tubular of a surface template. It is within the scope of the present invention that three or more well bores can be drilled from a common well bore utilizing separate tubulars of a surface template, in a manner as previously described, and that three or more wells can be drilled and separately completed from each of these well bores by means of the downhole or subsurface multiple well template of the present invention which is secured to each of such tubulars of the surface template.

While the foregoing preferred embodiments of the invention have been described and shown, it is understood that the alternatives and modifications, such as those suggested and others, may be made thereto and fall within the scope of the invention.

I claim:

1. A deformed template for drilling and completing multiple subterranean wells from a casing positioned in a subterranean well bore, said template comprising:

a body having at least two tubulars, each of said at least two tubulars being deformed to permit passage within said subterranean well bore but capable of being expanded upon application of suitable force, said at least two tubulars as deformed having a combined diameter which is greater than the diameter of the portion of the body which is not deformed; and means for securing said body to said casing.

2. The template of claim 1 wherein said at least two tubulars are deformed substantially symmetrically.

3. The template of claim 1 wherein said at least two tubulars are deformed asymmetrically.

4. The template of claim 1 wherein said at least two tubulars are axially symmetrical when expanded.

5. The template of claim 1 wherein said at least two tubulars are axially asymmetrical when expanded.

6. The template of claim 1 wherein said tubulars are divergent from each other.

7. The template of claim 1 wherein said body has three tubulars.

8. The template of claim 1 wherein one of said at least two tubulars is longer than any of the other tubulars.

9. The template of claim 1 wherein said means for securing comprises welds.

10. The template of claim 1 wherein said means for securing comprises a packer assembly which is attached around the periphery of said body.

11. The template of claim 1 wherein said casing is selected from the group consisting of drive pipe, conductor casing, surface casing, intermediate casing, production liner and intermediate liner.

12. The template of claim 1 wherein said casing is deviated.

13. The template of claim 1 wherein said body is constructed of multiple components.

14. The template of claim 1 wherein said at least two tubulars are welded together.

15. The template of claim 1 further comprising an elongated frame interposed between and secured to said at least two tubulars.

16. The template of claim 1 wherein said body is generally cylindrical.

17. The template of claim 1 wherein said body has a one common inlet in communication with each of said at least two tubulars.

18. A process for drilling wells via a casing which is selected from the group consisting of drive pipe, conductor casing, surface casing, intermediate casing, production liner and intermediate liner and which extends from the surface of the earth into a first subterranean well bore, said process comprising:

deforming each of at least two tubulars of a template such that the combined diameter of said at least two tubulars as deformed is greater than the diameter of the portion of the template which is not deformed;

securing said template having said at least two tubulars which are deformed to said casing;

expanding each of said at least two tubulars; and drilling a second subterranean well bore through one of said at least two tubulars.

19. The process of claim 18 further comprising;

enlarging the diameter of said first well bore so as to provide a subterranean area into which said at least two tubulars can be expanded.

20. The process of claim 18 further comprising:

securing a first length of production casing to said template, said first length of production casing extending into said second well bore.

21. The process of claim 20 further comprising:

producing hydrocarbons from said first subterranean formation penetrated by said second well bore to said surface of the earth via said first length of production casing and said first subterranean well bore.

22. The process of claim 20 further comprising:

securing a second deformed template to said first length of production casing.

23. The process of claim 18 further comprising:

drilling a third subterranean well bore through another of said at least two tubulars.

24. The process of claim 23 further comprising:

securing a second length of production casing to said template, said first length of production casing extending into said third well bore.

25. The process of claim 24 further comprising;

producing hydrocarbons to said surface of the earth via said second length of production casing and said first subterranean well bore.

26. The process of claim 23 which included drilling said first, second and third subterranean well bores to have substantially equal diameters.

27. The process of claim 18 further comprising:

securing a second deformed template to one of said at least two tubulars.

* * * * *